US006581665B2

(12) United States Patent
Lin

(10) Patent No.: US 6,581,665 B2
(45) Date of Patent: Jun. 24, 2003

(54) VENETIAN BLIND WITH UPPER AND LOWER SLAT UNITS THAT CAN BE ADJUSTED INDEPENDENTLY WITH RESPECT TO THEIR TILTING ANGLES

(76) Inventor: Shih-Ming Lin, No. 33, Nan-Ching-Nung-Chang, Ching-Ho Tsun, Shui-Shang, Chia-Yi Hsien (TW)

( * ) Notice: Subject to any disclaimer, the term of this patent is extended or adjusted under 35 U.S.C. 154(b) by 0 days.

(21) Appl. No.: 09/957,437

(22) Filed: Sep. 19, 2001

(65) Prior Publication Data

US 2003/0051824 A1 Mar. 20, 2003

(51) Int. Cl.[7] ..... E06B 3/48
(52) U.S. Cl. ..... 160/115; 160/178.3 R
(58) Field of Search ..... 160/115, 168.1 R, 160/176.1 R, 178.3 R, 178.1 R, 177 R

(56) References Cited

U.S. PATENT DOCUMENTS 2,148,812 A * 2/1939 Hollingsworth
2,237,539 A * 4/1941 Adams et al.
2,836,237 A * 5/1958 Hogin et al.
5,485,874 A * 1/1996 Whitmore
5,769,140 A * 6/1998 Tuzmen

* cited by examiner

*Primary Examiner*—Blair M. Johnson
(74) *Attorney, Agent, or Firm*—Ladas & Parry

(57) ABSTRACT

A Venetian blind includes upper and lower slats units whose tilting angles are independently and respectively controlled by first and second angle adjusting mechanisms. The first angle adjusting mechanism includes a first shaft journalled in a headrail, two pairs of first ladder cords secured to the first shaft and abutting against longitudinal sides of each of the upper slats, and a plurality of slat-supporting cords disposed respectively under the upper slats and extending between the first ladder cords. The second angle adjusting mechanism includes a second shaft journalled in the headrail, two pairs of second ladder cords secured to the second shaft and abutting against longitudinal sides of each of the lower slats, and a plurality of slat-supporting cords disposed respectively under the lower slats and extending between the second ladder cords.

4 Claims, 7 Drawing Sheets

VENETIAN BLIND WITH UPPER AND LOWER SLAT UNITS THAT CAN BE ADJUSTED INDEPENDENTLY WITH RESPECT TO THEIR TILTING ANGLES

BACKGROUND OF THE INVENTION

1. Field of the Invention

The present invention relates to a Venetian blind, more particularly to a Venetian blind with a plurality of upper slats whose tilting angle can be adjusted independently from the tilting angle of a plurality of lower slats.

2. Description of the Related Art

A conventional Venetian blind includes a hollow horizontal headrail, a horizontal rotary shaft journalled in the headrail, a plurality of slats suspended one above another from the headrail, a bottom rail disposed below the slats, an operating rod for controlling tilting of the slats, two pairs of ladder cords, and a pair of pull ropes. Each of the ladder cords is disposed at a longitudinal side of a respective end portion of each of the slats, and has a top end secured to the rotary shaft and a bottom end secured to the bottom rail such that axial rotation of the rotary shaft can cause the ladder cords to move up and down in order to tilt the slats. The operating rod is coupled to the rotary shaft, and is operable to actuate axial rotation of the rotary shaft, thereby controlling tilting of the slats. Each of the pull ropes passes through an aperture formed in a respective end portion of each of the slats, and has one end secured to the bottom rail, and another end extending out of the housing.

The aforementioned Venetian blind achieves the purposes of raising and lowering the slats and adjusting the tilting angle of the slats to control passage of light through the Venetian blind. However, all of the slats are adjusted simultaneously with respect to their tilting angles by operating the operating rod. When the slats are adjusted at a desired tilt to permit passage of an amount of light through the Venetian blind and into an interior, the interior might be visible from the outside through clearances among the slats. In the conventional Venetian blind, it is not possible to adjust the slats to permit passage of light through the Venetian blind while blocking vision into the interior for ensuring privacy at the same time.

SUMMARY OF THE INVENTION

Therefore, the main object of the present invention is to provide a Venetian blind with slats that can be adjusted in a manner to permit passage of light therethrough while ensuring user privacy.

Accordingly, the Venetian blind of the present invention includes a hollow horizontal headrail, upper and lower slat units, a bottom rail, two pull ropes, and first and second angle-adjusting mechanisms. The upper slat unit includes a plurality of parallel upper slats disposed under and parallel to the headrail. Each of the upper slats has two end portions that are opposite to each other along a longitudinal direction of a respective one of the upper slats. Each of the end portions is formed with a hole therethrough. The lower slat unit includes a plurality of parallel lower slats disposed under and parallel to the upper slats. Each of the lower slats has two end portions that are opposite to each other along a longitudinal direction of a respective one of the lower slats. Each of the end portions of the lower slats is formed with a hole therethrough. The bottom rail is disposed under and parallel to the lower slats, and has two end portions that are opposite to each other with respect to a longitudinal direction of the bottom rail. The pull ropes extend respectively through the holes in each of the upper and lower slats, and pass through the headrail. Each of the pull ropes has a mounting end that is fastened to a respective one of the end portions of the bottom rail, and an actuator end that is opposite to the mounting end and that is suspended from the headrail. The actuator end is actuatable to adjust raising and lowering of the upper and lower slats. The first angle-adjusting mechanism includes a first rotating shaft journalled within the headrail and extending along a longitudinal direction of the headrail, a first adjustment rod connected operatively to the first rotating shaft and capable of being actuated to rotate the first rotating shaft, and two first positioning cord units mounted respectively on two end portions of the first rotating shaft and connected respectively to the end portions of each of the upper slats. Each of the first positioning cord units includes two first ladder cords that have upper ends secured to the first rotating shaft and that abut respectively against two opposite longitudinal sides of each of the upper slats, and a plurality of parallel first slat-supporting cords, each of which is disposed under a respective one of the upper slats and has two opposite ends that are disposed respectively at the longitudinal sides of each of the upper slats and that are fastened respectively to the first ladder cords. The second angle-adjusting mechanism includes a second rotating shaft journalled within the headrail and extending along the longitudinal direction of the headrail, a second adjustment rod connected operatively to the second rotating shaft and capable of being actuated to rotate the second rotating shaft, and two second positioning cord units mounted respectively on two end portions of the second rotating shaft and connected respectively to the end portions of each of the lower slats. Each of the second positioning cord units includes two second ladder cords that have upper ends secured to the second rotating shaft and that abut respectively against two opposite longitudinal sides of each of the lower slats, and a plurality of parallel second slat-supporting cords, each of which is disposed under a respective one of the lower slats and has two opposite ends that are disposed respectively at the longitudinal sides of each of the lower slats and that are fastened to the second ladder cords. The tilting angle of the upper slats can be adjusted independently from that of the lower slats.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
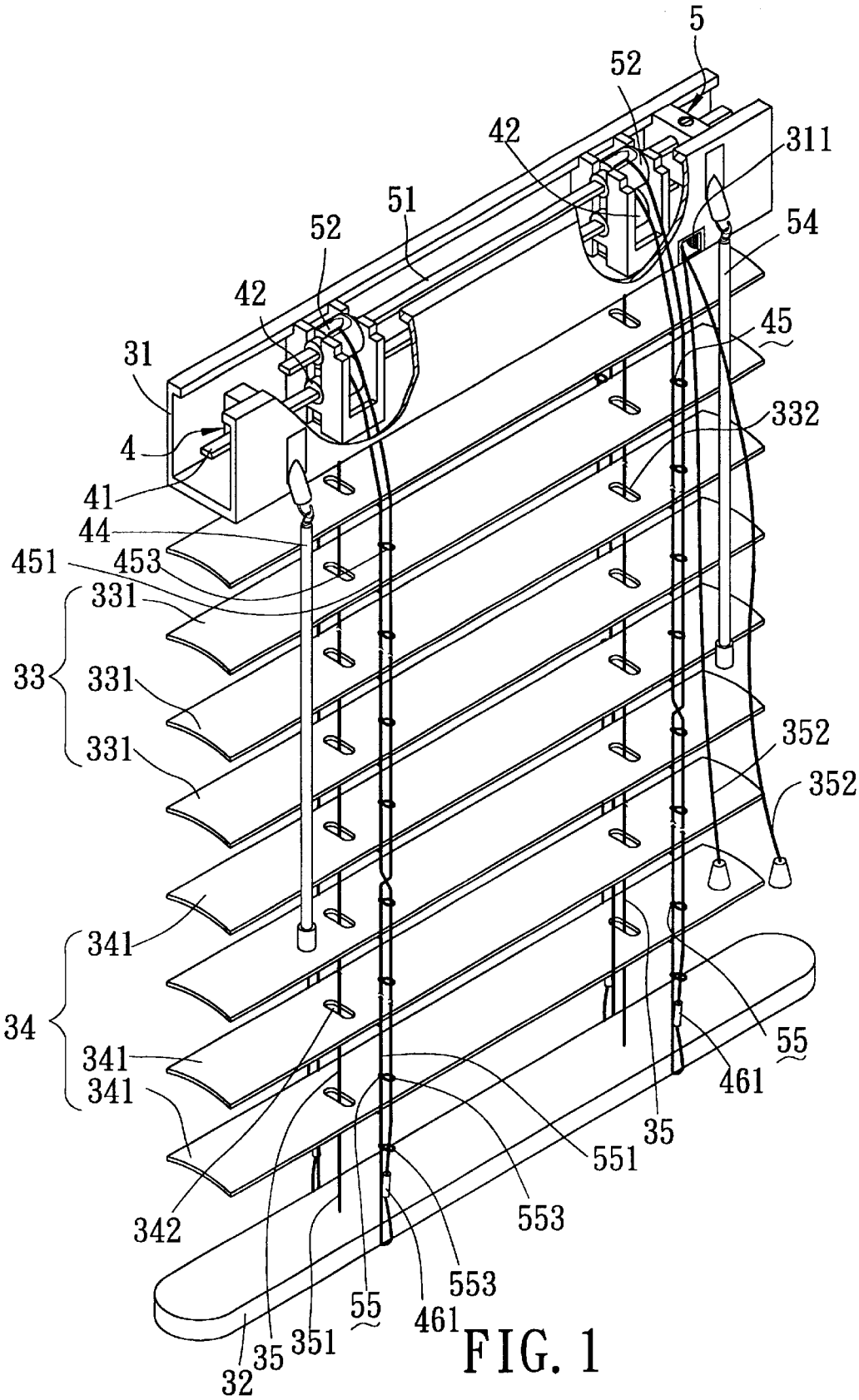
FIG. 1 is a perspective view of a first preferred embodiment of a Venetian blind of the present invention.

Before the present invention is described in greater detail, it should be noted that like elements are denoted by the same reference numerals throughout the disclosure.

Figure 2:
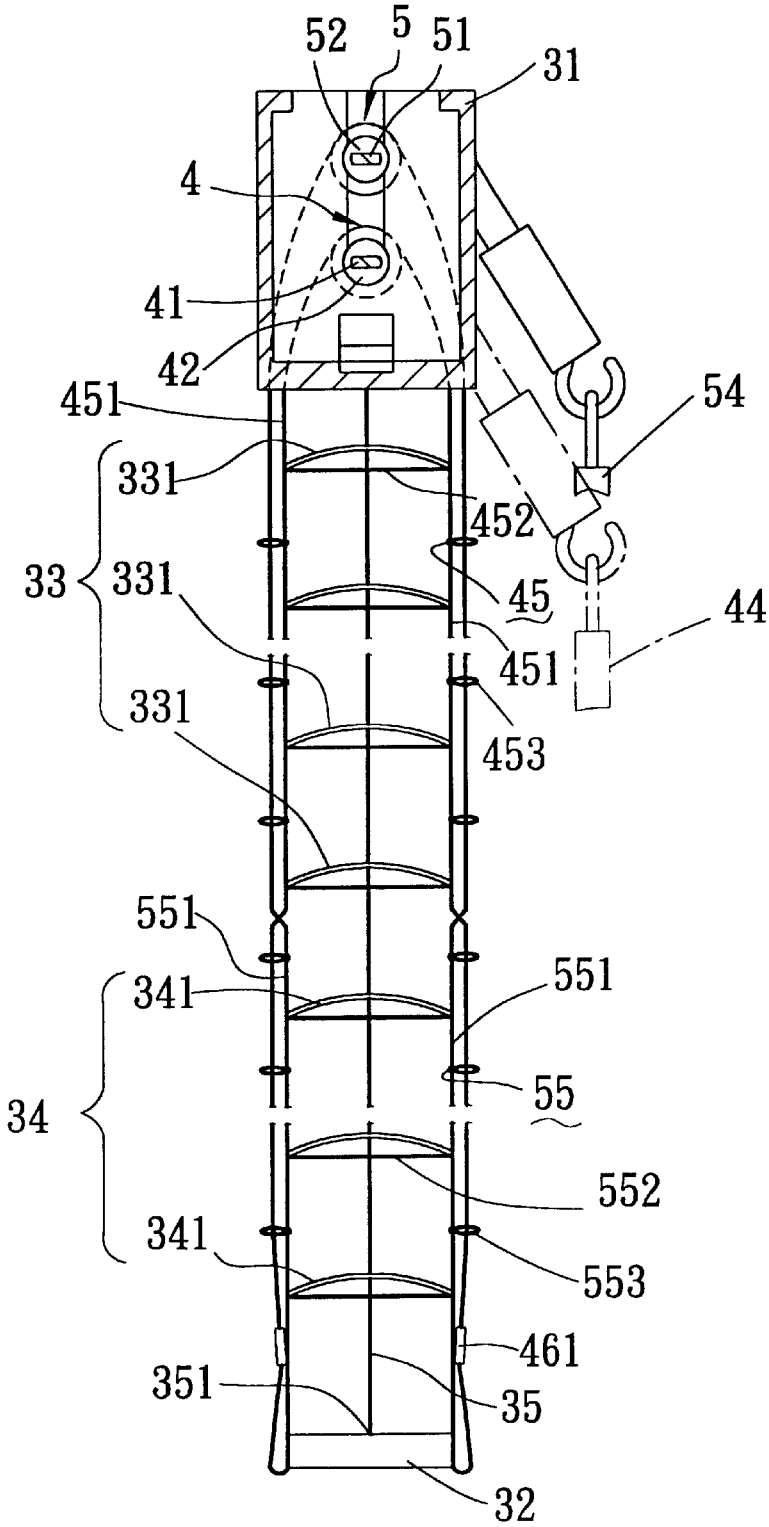
FIG. 2 is a partly-sectioned side view of the first preferred embodiment, where the slats are disposed in a horizontal orientation.

Referring to FIGS. 1 and 2, the first preferred embodiment of the Venetian blind of the present invention is shown to include a horizontal headrail 31, an upper slat unit 33 including a plurality of parallel upper slats 331, a lower slat unit 34 including a plurality of parallel lower slats 341, a bottom rail 32 disposed under and parallel to the lower slats 341, two pull ropes 35 passing through the upper and lower slats 331, 341, and first and second angle-adjusting mechanisms 4, 5.

The headrail 31 is formed as an elongated hollow casing with a U-shaped cross-section. The upper slats 331 are disposed under and parallel to the headrail 31. Each of the upper slats 331 has two end portions which are opposite to each other along a longitudinal direction of a respective one of the upper slats 331. Each of the end portions of the upper slats 331 is formed with a hole 332 therethrough. The hole 332 extends in a transverse direction that is transverse to the longitudinal direction of the respective upper slat 331. The lower slats 341 are disposed under and parallel to the upper slats 331. Each of the lower slats 341 has two end portions which are opposite to each other along a longitudinal direction of a respective one of the lower slats 341. Each of the end portions of the lower slats 341 is formed with a hole 342 therethrough. The hole 342 extends in a transverse direction that is transverse to the longitudinal direction of the respective lower slat 341.

The pull ropes 35 extend respectively through the holes 331, 341 in the end portions of each of the upper and lower slats 331, 341, and pass through the headrail 31. Each of the pull ropes 35 has a mounting end 351 that is fastened to a respective one of two longitudinally opposite end portions of the bottom rail 32, an actuator end 352 that is opposite to the mounting end 351 and that extends out of a pull rope locking device 311 mounted on the headrail 31. The actuator end 352 is suspended from the headrail 31, and can be actuated to adjust raising and lowering of the upper and lower slats 331, 341. Since the present invention is not characterized by the specific construction of the pull rope locking device 311, a detailed description thereof is omitted herein for the sake of brevity.

The first angle-adjusting mechanism 4 includes a first rotating shaft 41 journalled within the headrail 31 and extending along a longitudinal direction of the headrail 31, two first rotary wheels 42 sleeved respectively and non-rotatably on two opposite end portions of the first rotating shaft 41, a first adjustment rod 44, and two first positioning cord units 45 connected respectively to the two end portions of each of the upper slats 331. The first adjustment rod 44 is connected operably to the first rotating shaft 41 in a known manner, and is actuatable to rotate the first rotating shaft 41. Each of the first positioning cord units 45 is mounted on a respective one of the first rotary wheels 42, and includes two first ladder cords 451 and a plurality of first slat-supporting cords 452. Each of the first ladder cords 451 has an upper end secured to the respective one of the first rotary wheels 42, an upper section abutting against a respective one of two opposite longitudinal sides of each of the upper slats 331, a lower section extending downwardly from the upper section, and a lower end connected to the bottom rail 32. The lower end of each of the first ladder cords 451 is provided with a counterweight post 461 adjacent to the bottom rail 32. Each of the first ladder cords 451 has a sufficient length such that the lower end of each of the first ladder cords 451 is connected to the bottom rail 32 in a loose and non-tensioned state when the slats 331, 341 are fully lowered. With the aid of the counterweight posts 461, the first ladder cords 451 can be stretched downwardly. Each of the counterweight posts 461 may be in the form of a lead cylinder wrapped with a plastic cover. The first slat-supporting cords 452 are parallel and are spaced-apart vertically from one another. Each of the first slat-supporting cords 452 is disposed under a respective one of the upper slats 331, and has two opposite ends that are disposed respectively at the longitudinal sides of each of the upper slats 331 and that are tied and fastened respectively to the upper sections of the first ladder cords 451. The upper section of each of the first ladder cords 451 is provided with three positioning rings 453 which are aligned vertically and which are disposed above the lower slats 341.

Figure 3:
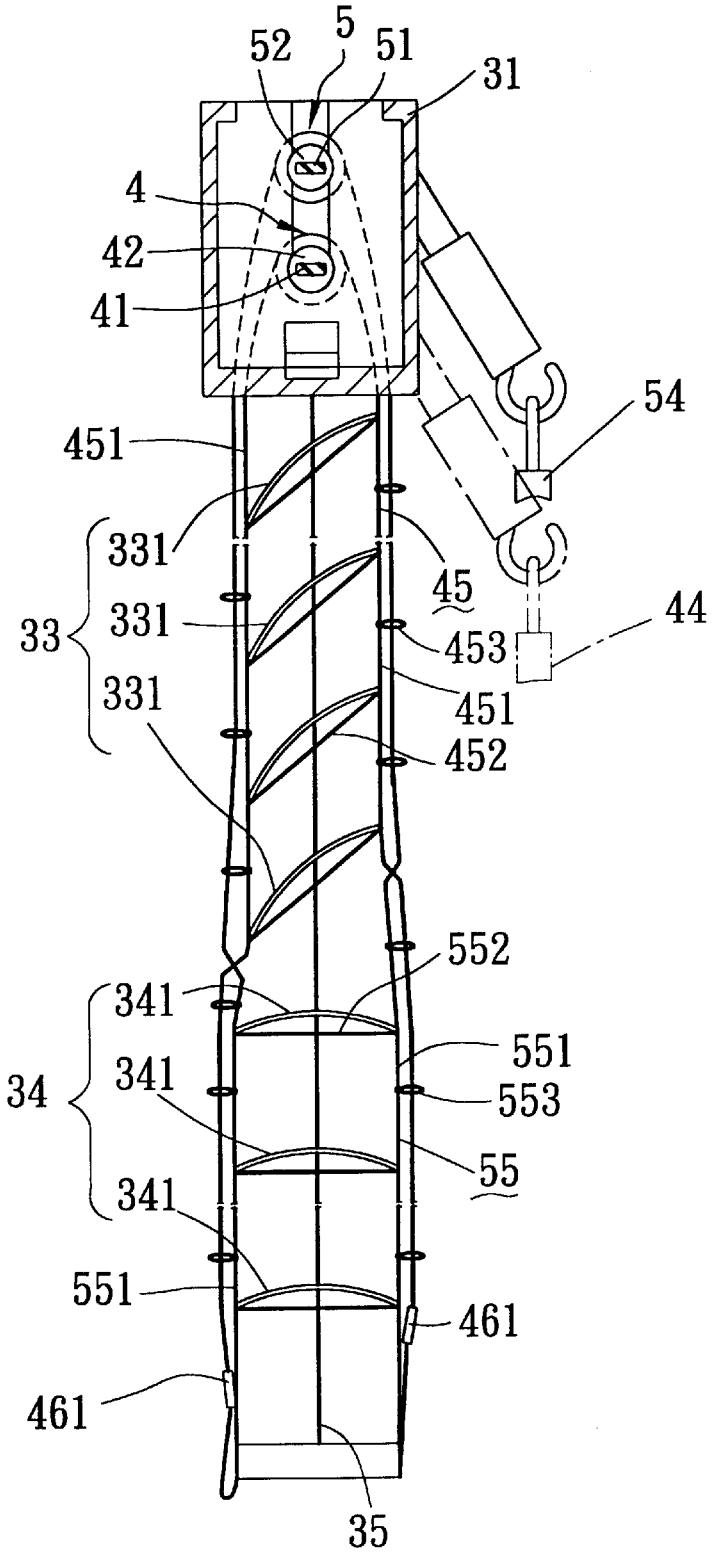
FIG. 3 is another partly-sectioned side view of the first preferred embodiment, when a plurality of upper slats are tilted.

When the first adjustment rod 44 is operated to rotate the first rotating shaft 41 and the first rotary wheels 42 in one direction, one of the first ladder cords 451 of each of the first positioning cord units 45 moves upwardly and the other one of the first ladder cords 451 of each of the first positioning cord units 45 moves downwardly to tilt the upper slats 331, as shown in FIG. 3. At this time, the lower slats 341 remain in their initial orientation, and do not move with the upper slats 331.

The second angle-adjusting mechanism 5 includes a second rotating shaft 51 journalled within the headrail 31 and disposed above and parallel to the first rotating shaft 41, two second rotary wheels 52 sleeved respectively and non-rotatably on two opposite end portions of the second rotating shaft 51, a second adjustment rod 54, and two second positioning cord units 55 connected respectively to the two end portions of each of the lower slats 341. The second adjustment rod 54 is connected operably to the second rotating shaft 51 in a known manner, and is actuatable to rotate the second rotating shaft 51. Each of the second positioning cord units 55 is mounted on a respective one of the second rotary wheels 52, and includes two second ladder cords 551 and a plurality of second slat-supporting cords 552. Each of the second ladder cords 551 has an upper end secured to the respective one of the second rotary wheels 52, an upper section extending through the positioning rings 453 of a respective one of the first ladder cords 451, a lower section abutting against a respective one of the longitudinal sides of each of the lower slats 341, and a lower end secured to the bottom rail 32. The bottom rail 32 thereby serves as a counterweight for stretching the second ladder cords 551. The second slat-supporting cords 552 are parallel and are spaced-apart vertically from one another. Each of the second slat-supporting cords 552 is disposed under a respective one of the lower slats 341, and has two opposite ends that are disposed respectively at the longitudinal sides of each of the lower slats 341 and that are tied and fastened respectively to the lower sections of the second ladder cords 551. The lower section of each of the second ladder cords 551 is provided with three positioning rings 553 which are aligned vertically and which are disposed below the upper slats 331 to permit extension of the lower section of a respective one of the first ladder cords 451 therethrough.

Likewise, when the second adjustment rod 54 is operated to rotate the second rotating shaft 51 and the second rotary wheels 52 in one direction, one of the second ladder cords 551 of each of the second positioning cord units 55 moves upwardly and the other one of the second ladder cords 551 of each of the second positioning cord units 55 moves downwardly to tilt the lower slats 341. At this time, the orientation of the upper slats 331 remains unchanged, and the tilting angle of the lower slats 341 is adjusted independently from that of the upper slats 331.

With the use of the Venetian blind of the present invention, the tilting angles of the upper and lower slat units 33, 34 can be adjusted independently. In practice, the upper slat unit 33 is designed to be located at a level sufficiently higher than the heights of people indoors. When a person wishes to permit entry of an amount of light into the interior and while ensuring personal privacy, the upper slat unit 33 can be adjusted at a tilting angle which permits a desired amount of light to pass through the Venetian blind, whereas the lower slats 341 can be adjusted to be in a substantially upright orientation to block visibility through the corresponding part of the Venetian blind.

Figure 4:
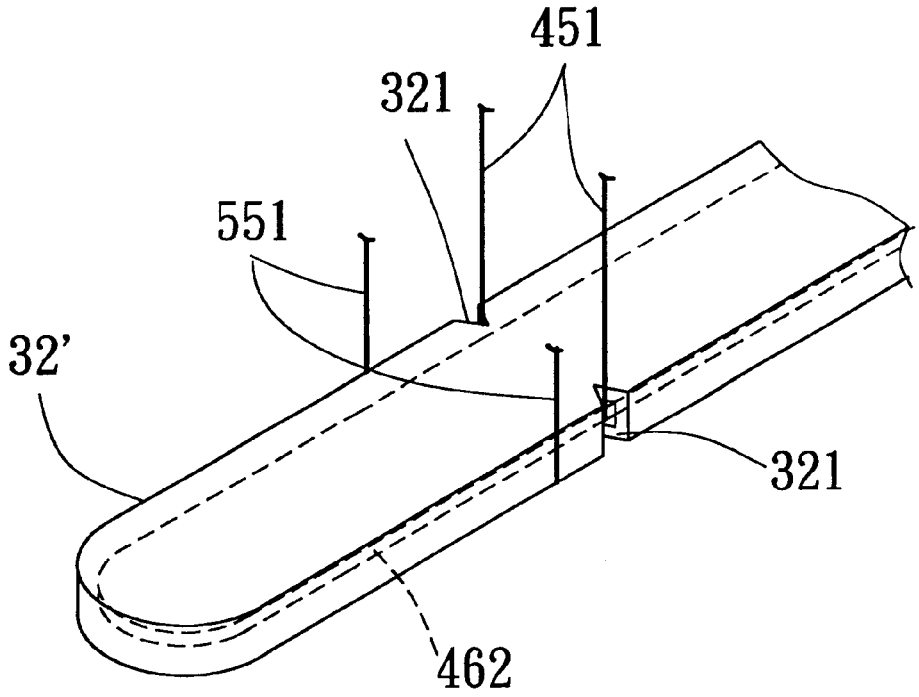
FIG. 4 is a fragmentary perspective view illustrating a bottom rail of a second preferred embodiment of the Venetian blind of the present invention.
Figure 5:
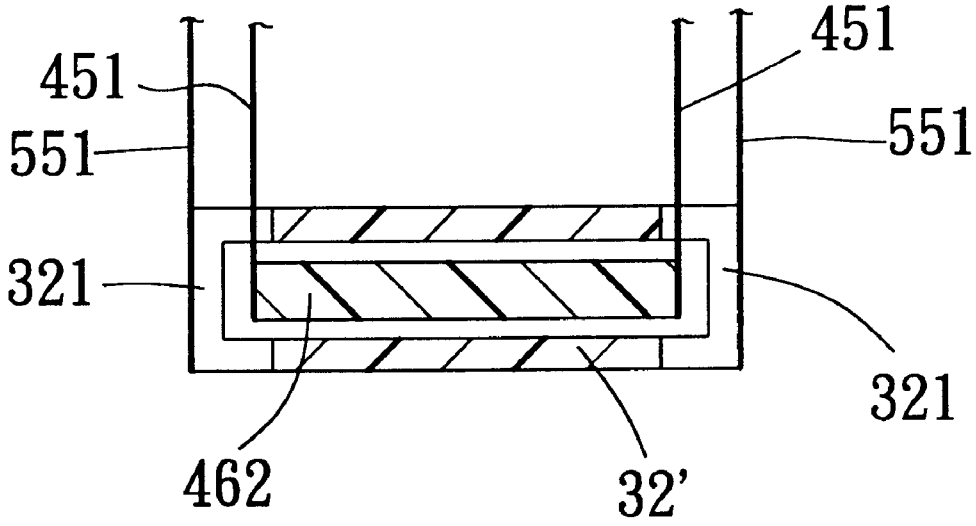
FIG. 5 is a fragmentary sectional view of the bottom rail of FIG. 4.

Referring to FIGS. 4 and 5, the second preferred embodiment of the Venetian blind of this invention differs from the first preferred embodiment in that the lower ends of the first ladder cords 451 are fastened to a counterweight plate 462 disposed in the bottom rail 32', instead of being fastened to the counterweight posts 461. The bottom rail 32' is hollow and has two opposite longitudinal edges, each of which is formed with an opening 321 at a respective end portion of the bottom rail 32'. The lower ends of the first ladder cords 451 extend into the bottom rail 32' via the openings 321 and are fastened to the counterweight plate 462 for suspending the counterweight plate 462 movably within the bottom rail 32'. As with the previous embodiment, the lower ends of the second ladder cords 551 are fastened to the bottom rail 32'.

In other embodiments, both the first and second ladder cords 451, 551 may be secured to the bottom rail 32 in a manner that the bottom rail 32 serves as a counterweight for both of the first and second ladder cords 451, 551.

Figure 6:
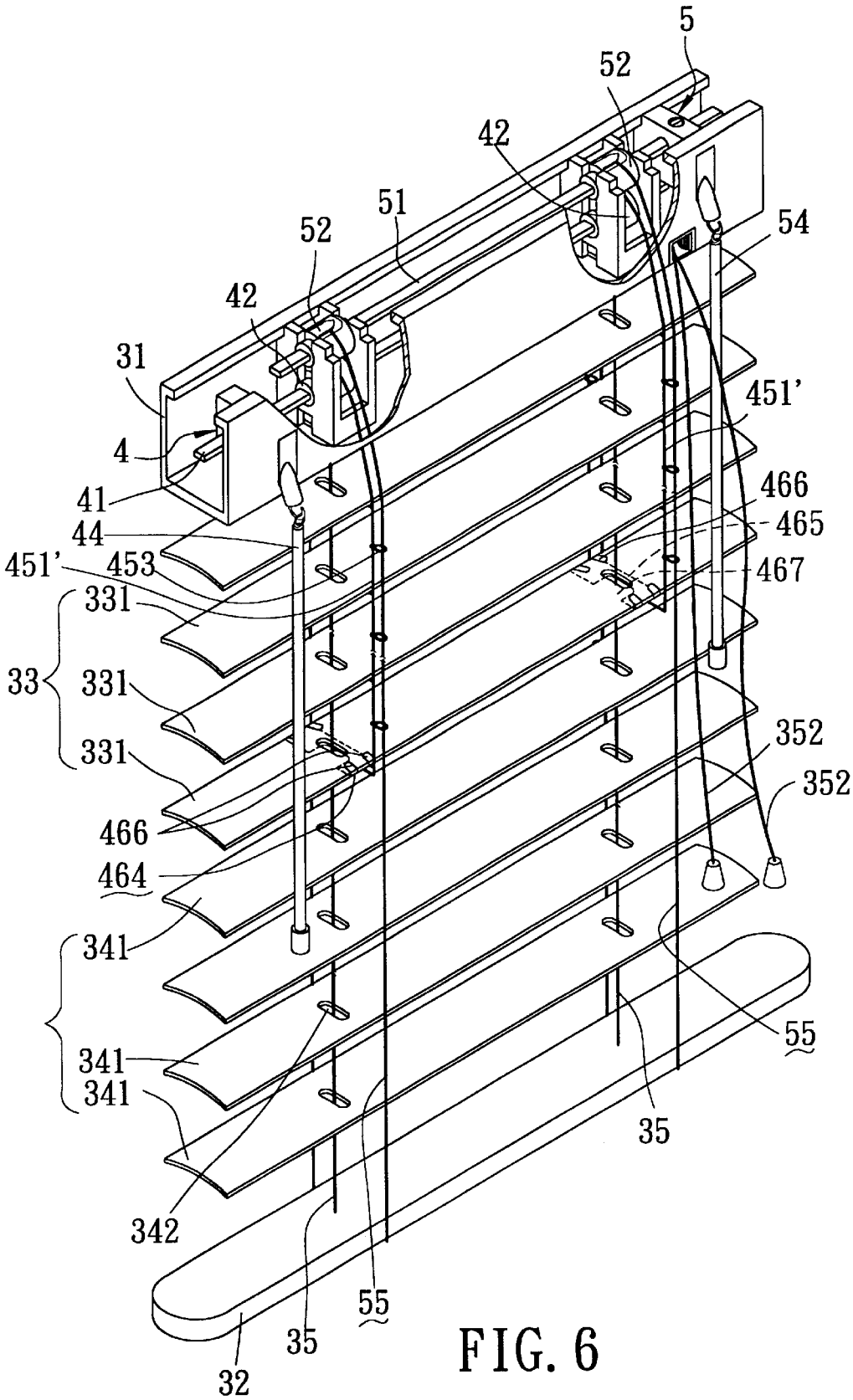
FIG. 6 is a perspective view of a third preferred embodiment of the Venetian blind of the present invention.
Figure 7:
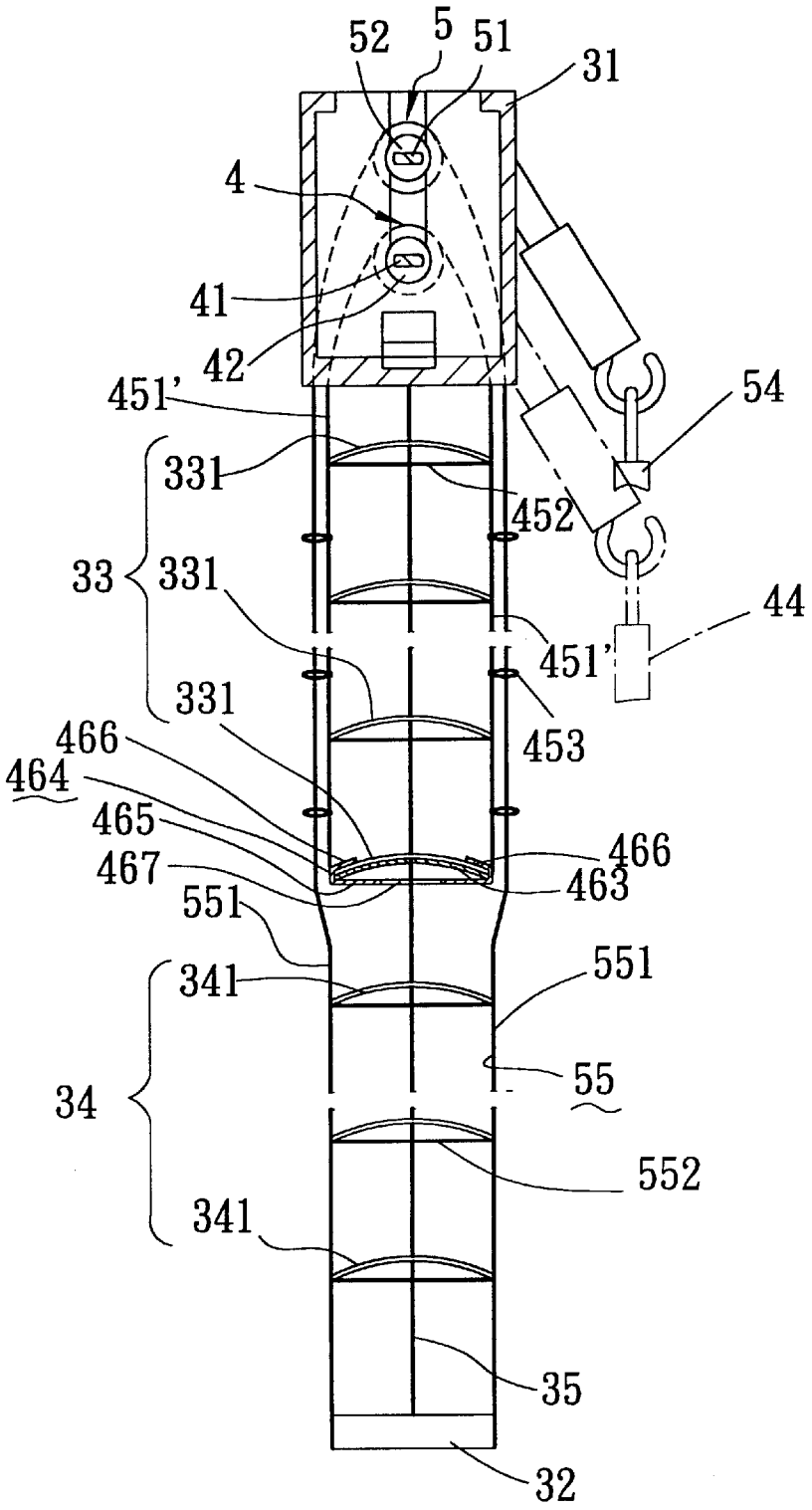
FIG. 7 is a partly-sectioned side view of the third preferred embodiment.

In a third preferred embodiment of the present invention shown in FIGS. 6 and 7, the first ladder cords 451' are shorter in length, and do not extend to the lower slats 341. The lower end of each of the first ladder cords 451' is disposed above the lower slats 341, and is fastened to a counterweight strip 463 that is disposed under a lowermost one of the upper slats 331. A pair of clamping members 464 are provided at two opposite end portions of the lowermost one of the upper slats 331 for clamping together the counterweight strip 463, the lowermost one of the upper slats 331 and the lower ends of the first ladder cords 451'. Each of the clamping members 464 includes a base plate 465 disposed under the counterweight strip 463, and two opposite forked clip portions 466 which are disposed respectively on the longitudinal sides of the lowermost one of the upper slats 331. The clip portions 466 are bent from two opposite ends of the base plate 465, and abut against a top side of the lowermost one of the upper slats 331. The lower ends of the first ladder cords 451' pass between furcations of the forked clip portions 466 and are clamped between the counterweight strip 463 and the lowermost one of the upper slats 331 by the clip portions 466 of the clamping members 464. The base plate 465 of each of the clamping members 464 has a notch 467 to permit passage of a respective one of the pull ropes 35 therethrough.

Since the first ladder cords 451' do not extend to the lower slats 341, the lower sections of the second ladder cords 551 are not required to be provided with the second positioning rings 553.

It is noted that, in other embodiments, more than two slat units that can be independently adjusted may be provided. Of course, the slat units are controlled by their respective angle-adjusting mechanisms such that they can be adjusted independently with respect to their tilting angles.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. Venetian blind comprising:

a hollow horizontal headrail;

an upper slat unit including a plurality of parallel upper slats disposed under and parallel to said headrail, each of said upper slats having two end portions that are opposite to each other along a longitudinal direction of a respective one of said upper slats, each of said end portions being formed with a hole therethrough;

a lower slat unit including a plurality of parallel lower slats disposed under and parallel to said upper slats, each of said lower slats having two end portions that are opposite to each other along a longitudinal direction of a respective one of said lower slats, each of said end portions of said lower slats being formed with a hole therethrough;

a bottom rail disposed under and parallel to said lower slats, and having two end portions that are opposite to each other with respect to a longitudinal direction of said bottom rail;

two pull ropes extending respectively through said holes in each of said upper and lower slats and passing through said headrail, each of said pull ropes having a mounting end that is fastened to a respective one of said end portions of said bottom rail, and an actuator end that is opposite to said mounting end and that is suspended from said headrail, said actuator end being actuatable to adjust raising and lowering of said upper and lower slats;

a first angle-adjusting mechanism including a first rotating shaft journalled within said headrail and extending along a longitudinal direction of said headrail, a first adjustment rod connected operatively to said first rotating shaft and capable of being actuated to rotate said first rotating shaft, and two first positioning cord units mounted respectively on two end portions of said first rotating shaft and connected respectively to said end portions of each of said upper slats, each of said first positioning cord units including two first ladder cords that have upper ends secured to said first rotating shaft and that abut respectively against two opposite longitudinal sides of each of said upper slats, and a plurality of parallel first slat-supporting cords, each of which is disposed under a respective one of said upper slats, and has two opposite ends that are disposed respectively at said longitudinal sides of each of said upper slats and that are fastened respectively to said first ladder cords; and a second angle-adjusting mechanism including a second rotating shaft journalled within said headrail and extending along the longitudinal direction of said headrail, a second adjustment rod connected operatively to said second rotating shaft and capable of being actuated to rotate said second rotating shaft, and two second positioning cord units mounted respectively on two end portions of said second rotating shaft and connected respectively to said end portions of each of said lower slats, each of said second positioning cord units including two second ladder cords that have upper ends secured to said second rotating shaft, and that abut respectively against two opposite longitudinal sides of each of said lower slats, and a plurality of parallel second slat-supporting cords, each of which is disposed under a respective one of said lower slats and has two opposite ends that are disposed respectively at said longitudinal sides of each of said lower slats and that are fastened to said second ladder cords;

whereby, tilting angle of said upper slats can be adjusted independently from that of said lower slats; and wherein said bottom rail is hollow, each of said end portions of said bottom rail being formed with two openings in two opposite longitudinal sides thereof, said first angle-adjusting mechanism further including a horizontal counterweight plate that is disposed movably within said bottom rail, said first ladder cords having lower ends that extend into said bottom rail via said openings, respectively, and that are fastened to said counterweight plate, each of said second ladder cords having a lower end that is fastened to said bottom rail.

2. A Venetian blind comprising:

a hollow horizontal headrail;

an upper slat unit including a plurality of parallel upper slats disposed under and parallel to said headrail, each of said upper slats having two end portions that are opposite to each other along a longitudinal direction of a respective one of said upper slats, each of said end portions being formed with a hole therethrough;

a lower slat unit including a plurality of parallel lower slats disposed under and parallel to said upper slats, each of said lower slats having two end portions that are opposite to each other along a longitudinal direction of a respective one of said lower slats, each of said end portions of said lower slats being formed with a hole therethrough;

a bottom rail disposed under and parallel to said lower slats, and having two end portions that are opposite to each other with respect to a longitudinal direction of said bottom rail;

two pull ropes extending respectively through said holes in each of said upper and lower slats and passing through said headrail, each of said pull ropes having a mounting end that is fastened to a respective one of said end portions of said bottom rail, and an actuator end that is opposite to said mounting end and that is suspended from said headrail, said actuator end being actuatable to adjust raising and lowering of said upper and lower slats;

a first angle-adjusting mechanism including a first rotating shaft journalled within said headrail and extending along a longitudinal direction of said headrail, a first adjustment rod connected operatively to said first rotating shaft and capable of being actuated to rotate said first rotating shaft, and two first positioning cord units mounted respectively on two end portions of said first rotating shaft and connected respectively to said end portions of each of said upper slats, each of said first positioning cord units including two first ladder cords that have upper ends secured to said first rotating shaft and that abut respectively against two opposite longitudinal sides of each of said upper slats, and a plurality of parallel first slat-supporting cords, each of which is disposed under a respective one of said upper slats, and has two opposite ends that are disposed respectively at said longitudinal sides of each of said upper slats and that are fastened respectively to said first ladder cords; and a second angle-adjusting mechanism including a second rotating shaft journalled within said headrail and extending along the longitudinal direction of said headrail, a second adjustment rod connected operatively to said second rotating shaft and capable of being actuated to rotate said second rotating shaft, and two second positioning cord units mounted respectively on two end portions of said second rotating shaft and connected respectively to said end portions of each of said lower slats, each of said second positioning cord units including two second ladder cords that have upper ends secured to said second rotating shaft, and that abut respectively against two opposite longitudinal sides of each of said lower slats, and a plurality of parallel second slat-supporting cords, each of which is disposed under a respective one of said lower slats and has two opposite ends that are disposed respectively at said longitudinal sides of each of said lower slats and that are fastened to said second ladder cords;

whereby, tilting angle of said upper slats can be adjusted independently from that of said lower slats;

wherein each of said first ladder cords has a lower end that is located above said lower slats, said first angle-adjusting mechanism further including a counterweight strip which is disposed under a lowermost one of said upper slats and which has two end portions that are fastened to said lower ends of said first ladder cords, said bottom rail being fastened to lower ends of said second ladder cords, thereby serving as a counterweight; and a clamping unit for clamping together said lower ends of said first ladder cords, said counterweight strip, and said lowermost one of said upper slats.

3. The Venetian blind as claimed in claim 2, wherein said clamping unit includes a pair of clamping members, each of which is disposed on a respective one of said end portions of said counterweight strip and a respective one of said end portions of said lowermost one of said upper slats, said lower ends of said first ladder cords being clamped between said counterweight strip and said lowermost one of said upper slats by said clamping members.

4. The Venetian blind as claimed in claim 3, wherein each of said clamping members includes a base plate disposed under said counterweight strip, and two opposite clip portions formed on two opposite ends of said base plate and disposed respectively adjacent to said longitudinal sides of said lowermost one of said upper slats, said clip portions being bent from said base plate and abutting against a top side of said lowermost one of said upper slats.

* * * * *